US008389904B2

(12) United States Patent
Pottiez et al.

(10) Patent No.: US 8,389,904 B2
(45) Date of Patent: Mar. 5, 2013

(54) GLOW PLUG

(75) Inventors: Christian Pottiez, Eppingen (DE); Jochen Hammer, Stuttgart (DE); Yue Cheng, Asperg (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 277 days.

(21) Appl. No.: 12/853,819

(22) Filed: Aug. 10, 2010

(65) Prior Publication Data

US 2011/0062136 A1 Mar. 17, 2011

(30) Foreign Application Priority Data

Aug. 12, 2009 (DE) ..... 10 2009 037 375

(51) Int. Cl.
*H05B 3/00* (2006.01)

(52) U.S. Cl. ..... 219/201; 219/205; 123/179.6

(58) Field of Classification Search ..... 219/201, 219/205; 123/179.6
See application file for complete search history.

(56) References Cited

U.S. PATENT DOCUMENTS

| | | | | |
|---|---|---|---|---|
| 4,499,366 | A | 2/1985 | Yoshida et al. | |
| 5,189,280 | A | 2/1993 | Okazaki et al. | |
| 6,575,138 | B2 * | 6/2003 | Welch et al. | 123/467 |
| 7,121,342 | B2 * | 10/2006 | Vinegar et al. | 166/302 |
| 7,313,949 | B2 * | 1/2008 | Yorita et al. | 73/114.07 |
| 7,635,826 | B2 * | 12/2009 | Yamada et al. | 219/270 |
| 2001/0032612 | A1 * | 10/2001 | Welch et al. | 123/294 |
| 2002/0134138 | A1 | 9/2002 | Philipp et al. | |
| 2007/0209624 | A1 | 9/2007 | Ludwig et al. | |
| 2010/0032423 | A1 | 2/2010 | Kern et al. | |

FOREIGN PATENT DOCUMENTS

| | | | |
|---|---|---|---|
| DE | 658 420 | A | 4/1938 |
| DE | 10 2005 061 879 | A1 | 7/2007 |

* cited by examiner

*Primary Examiner* — Eugene Lee

(57) ABSTRACT

The invention relates to a glow plug for Diesel engines, comprising a housing, a heater rod, which is movable in the housing in axial direction and projects from the housing at a forward end, and a pressure measuring device for measuring a combustion chamber pressure exerted on the heater rod. It is provided according to the invention that a housing chamber is filled with a substance having or achieving liquid to paste-like consistency at temperatures occurring during operation and conducting heat generated by the heater rod to the housing.

18 Claims, 1 Drawing Sheet

GLOW PLUG

The invention generally refers to a glow plug known from WO 2005/090865 A1.

The present invention aims at showing a way how the combustion chamber pressure of a Diesel engine can be measured with increased accuracy by means of a pressure measuring device of a glow plug.

This problem is solved by a glow plug in accordance with the present invention.

SUMMARY OF THE INVENTION

In a glow plug according to the invention, a substance is filled into a sealed interior housing region, said substance having or achieving liquid to paste-like consistency at the temperatures occurring during operation and conducting heat generated by the heater rod to the housing. In this manner, the thermal coupling of the heater rod to the housing is improved. Surprisingly, this allows achieving a considerable improvement in measuring accuracy. That is to say that it has been detected within the scope of the invention that different thermal expansions of the housing and the heater rod may cause the development of pressure-independent axial movements of the heater rod, said movements falsifying the pressure measurement. A substance filled into a chamber in the housing can be used to dissipate temperature gradients between the heater rod and the housing, with the result that this error source is reduced.

The substance filled into the interior housing region must not prevent an axial movement of the heater rod. For this reason, it is essential that the substance used has or achieves liquid to paste-like consistency at the temperatures occurring during operation. The filled-in substance does not do any harm if it solidifies with idle engine because pressure measurements are, in any case, only taken while the engine is running. While the engine is running, the glow plug is heated, with the result that the substance used for heat dissipation becomes liquid or paste-like. Preferably, the substance used for heat dissipation is liquid or paste-like at 100° C., most preferably within the complete range of application from −40° C. to 400° C.

For example, organic or organosilicon substances having a wax-like or oily consistency are suitable. At the temperatures occurring in the interior region of a glow plug while the engine is running, oils—in particular mineral oils and silicone oils—have a viscosity that is advantageously low, with the result that axial movements of the heater rod are, at most, impaired within the relevant temperature range to an insignificant degree only. The oils used can be liquid or paste-like at room temperature, but this is not strictly necessary. The oils used do not do any harm if they have a wax-like consistency at room temperature and only liquefy or become paste-like at temperatures of 100° C. or higher.

While the engine is running, temperatures ranging from 100° C. to 400° C. may occur in a chamber of a forward housing section on the side of the combustion chamber. That is why, for heat dissipation purposes, the heater rod can, in a forward part of the housing, also be surrounded by a metal that liquefies at such temperatures, said metal, for example, being a soft solder alloy, an alkaline metal, in particular sodium, or their compounds. Soft solder alloys, for example tin/lead alloys and/or indium alloys, have a good thermal conductivity and are, therefore, able to dissipate heat from a backward region of the heater rod to the housing. Where ceramic and metallic heater rods are concerned, the outside of the heater rod is usually applied to ground, for which reason it is not necessary to electrically insulate the heater rod against the housing. That is why the electric conductance of a soft solder alloy surrounding the heater rod in the housing does not present any drawback.

BRIEF DESCRIPTION OF THE DRAWINGS

Further details and advantages of the invention will be illustrated by means of exemplary embodiments with reference being made to the accompanying drawings. Therein, identical parts that are corresponding to each other will be identified by corresponding reference symbols. In the drawings.

DETAILED DESCRIPTION

Figure 1:
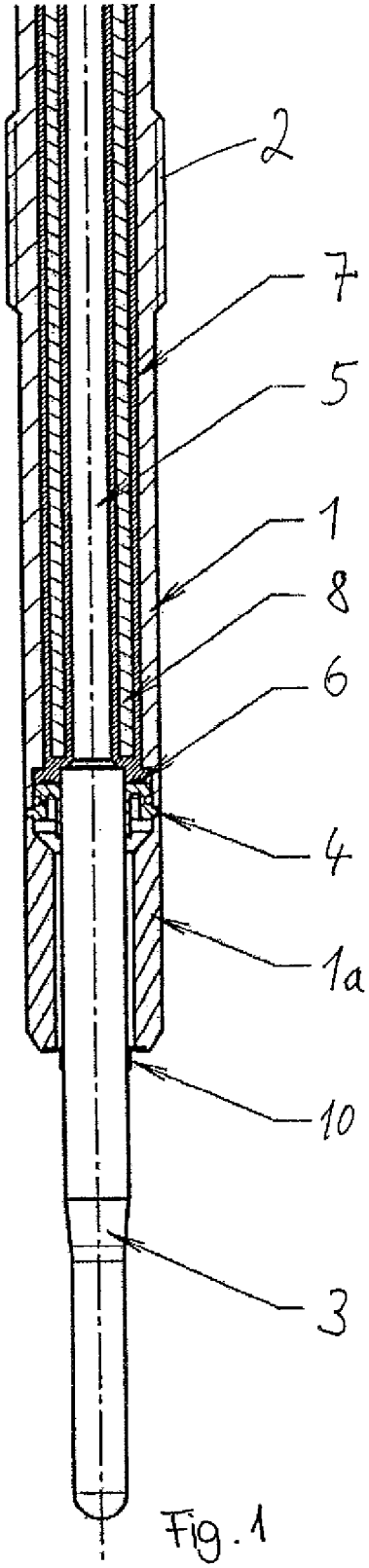
FIG. 1 is a schematic diagram of an exemplary embodiment of a glow plug according to the invention.

The glow plug shown in FIG. 1 has a housing 1 with an external thread 2 for screwing it into an engine block. A heater rod 3 which is movable in the housing 1 in axial direction projects from the forward end of the housing 1. The combustion chamber pressure exerted on the heater rod 3 can be measured by means of a pressure measuring device which, in the exemplary embodiment shown, comprises a measuring diaphragm 4 that is attached to the housing 1, for example, by being fixed between a forward and a backward part of the housing. The measuring diaphragm 4 subdivides the interior housing region into a forward partial region and a backward partial region. The measuring diaphragm 4 is, preferably, attached to the heater rod 3 with its inner circumference. As a matter of principle, however, the measuring diaphragm 4 could also be attached to an inner pole 5 which is used to supply the heater rod 3 with power during operation. In the exemplary embodiment shown, the inner pole 5 can be designed as a rod or as a litz wire. Preferably, the inner pole 5 is enclosed by an insulation sleeve 8.

The higher the combustion chamber pressure exerted on the heater rod 3, the further will the heater rod 3 be pressed into the housing 1 against a restoring force. This movement of the heater rod 3 can be used for a pressure measurement. In the exemplary embodiment shown, an axial movement of the heater rod 3 causes a deformation of the measuring diaphragm 4, said deformation generating a restoring force. This deformation can be registered by means of one or more measuring elements 6 carried by the measuring diaphragm 4, said measuring elements 6, for example, being strain gauges. Preferably, the measuring elements 6 are arranged on that side of the measuring diaphragm 4 that faces the backward end of the housing 1. Before they are transmitted by means of signal lines (not shown) extending along the inner pole 5, the measurement signals generated by the measuring element or the measuring elements can be processed with an electronic module that is not shown here.

Different thermal expansions of the heater rod 3 and the surrounding housing 1 can also cause a deformation of the measuring diaphragm 4 and, therefore, falsify the pressure measurement. To counteract this, a chamber in the housing is filled with an organic or organosilicon substance 7 having a wax-like or oily consistency, said substance 7 dissipating heat from the heater rod 3 to the housing 1. In the exemplary embodiment shown in FIG. 1, a chamber in backward part of the housing 1 between the measuring diaphragm 4 and a tightly closed backward housing end is filled with silicone oil 7. The silicone oil 7 surrounds the inner pole 5 running to the heater rod 3 and dissipates heat from the backward end of the heater rod 3 and the measuring diaphragm 4. By means of silicone oil, radial temperature gradients are counteracted in the vicinity of the heater rod connection where the pressure measuring device is arranged. For this reason, different thermal expansions of the heater rod 3 and the housing 1 are, at best, occurring in the vicinity of the pressure measuring device to a reduced extent only, with the result that, based on an axial movement of the heater rod 3, the combustion chamber pressure can be determined with increased accuracy.

Figure 2:
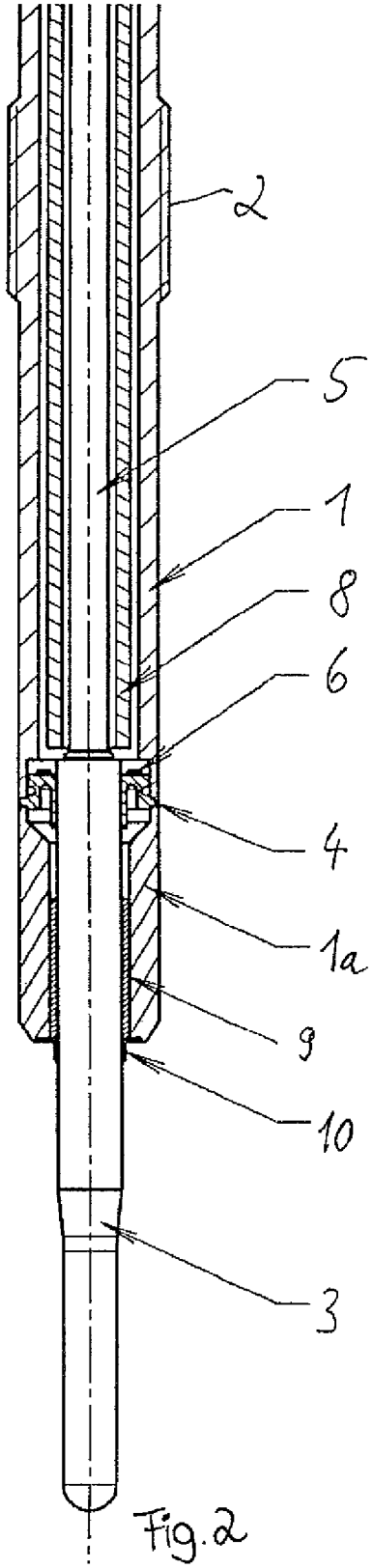
FIG. 2 is a further exemplary embodiment of a glow plug.

FIG. 2 shows a further exemplary embodiment of a glow plug which differs from the exemplary embodiment described above only in that a chamber in a forward part of the housing is filled with a heat-conducting substance 9. At its forward end, the housing 1 is closed by a seal 10 which can, for example, be designed as a diaphragm attached to the heater rod 3 and the housing 1. The metal diaphragm that is used as the seal 10 can be soldered to a ceramic heater rod 3 or welded to the metalk protective sleeve thereof. Preferably, the metal diaphragm used as the seal 10 is welded to a forward housing part 1*a*; however, it can also be soldered thereto. If a metallic heater rod is used in the stead of a ceramic heater rod, the metal diaphragm can be welded to the heater rod 3. The metal diaphragm can also be formed integrally with the housing or the housing part 1*a*.

The substance 9 filled into the forward part of the housing 1 and surrounding the heater rod 3 can, for example, be a mineral oil or a low-melting-point metal, for example, a soft solder alloy or an alkaline metal. The substance 9 surrounding the heater rod 3 has a liquid or paste-like, preferably liquid, consistency at least at the temperatures of more than 200° C. occurring in the forward housing part 1*a* during operation, preferably already at 100° C., and dissipates heat from the heater rod 3 to the surrounding housing 1, 1*a*, without preventing an axial movement of the heater rod 3. A great number of indium alloys, in particular indium/bismuth alloys, for example In51Bi32.5Sn16.5, have melting points of considerably less than 100° C.

In order to ensure that a thermal expansion of the substance 7, 9 used to dissipate heat into the interior housing region does not cause a falsification of the pressure measurement, the available region or partial region in the interior region of the housing 1 is only partially filled with the heat-conducting substance 7, 9, and it always contains some air as well. As can be seen from FIG. 2, the partial region between the seal 10 at the forward end of the housing 1 and the measuring diaphragm 4 is only partially filled with the heat-conducting substance 9. The filling level can range from 20% to 95%. Filling levels ranging from 50% to 95% are preferred. In corresponding manner, the backward partial region in FIG. 1 is also, preferably, only partially filled with the heat-conducting substance 7. To simplify matters, FIG. 1 does not show a corresponding air bubble and a seal at the backward end of the housing 1.

The exemplary embodiments shown in FIGS. 1 and 2 can be combined by filling a heat-conducting substance 7 or 9, respectively, into each of the backward partial region of the housing 1 as well as the forward partial region of the housing 1. In this case, use is, preferably, made of different substances for the forward and the backward partial regions. Preferably, an electrically insulating oil, in particularly a silicone oil, is used for the forward partial region. Electrically insulating properties are irrelevant for the backward partial region; instead, a higher temperature resistance is required.

In the exemplary embodiment shown in FIG. 1, the heat dissipation from the heater rod 3 to the surrounding housing 1 can, in addition, also be improved by arranging a ring or a sleeve made of an elastomer, for example, a perfluoroelastomer, between the heater rod 3 and the housing 1. Perfluoroelastomers are to advantage in that they combine a high temperature resistance with a low friction coefficient.

Reference Symbols

1 Housing
1*a* Housing part
2 External thread
3 Heater rod
4 Measuring diaphragm
5 Inner pole
6 Strain gauge
7 Substance
8 insulation sleeve
9 Substance
10 Seal

The invention claimed is:

1. A glow plug for Diesel engines, comprising:
a housing;
a heater rod that is movable in the housing in an axial direction and projecting from the housing at a forward end;
a pressure measuring device for measuring a combustion chamber pressure exerted on the heater rod, wherein the pressure measuring device comprises a measuring diaphragm; and
a housing chamber filled with a substance having or achieving a liquid to paste-like consistency at temperatures occurring during operation and conducting heat generated by the heater rod to the housing, wherein said housing chamber is arranged between the measuring diaphragm and an end of the housing.

2. The glow plug according to claim 1, wherein the substance is an organic or organosilicon substance having a wax-like or oily consistency.

3. The glow plug according to claim 1, wherein the substance is an oil.

4. The glow plug according to claim 3, wherein the oil is a mineral oil.

5. The glow plug according to claim 1, wherein the oil is a silicone oil.

6. The glow plug according to claim 1, wherein the substance is a metal.

7. The glow plug according to claim 1, wherein the substance is a soft solder alloy.

8. The glow plug according to claim 1, wherein the substance is an alkaline metal.

9. The glow plug according to claim 1, wherein the measuring diaphragm is deformed during an axial movement of the heater rod.

10. The glow plug according to claim 9, wherein the measuring diaphragm carries one or more strain gauges.

11. The glow plug according to claim 1, wherein a sealing diaphragm sealing the housing chamber at its forward end is attached to the heater rod.

12. The glow plug according to claim 1, wherein the chamber is only partially filled with the substance.

13. The glow plug according to claim 1, wherein the chamber is filled with the substance between 50% and 95% at room temperature.

14. The glow plug according to claim 1, wherein the housing has a forward chamber and a backward chamber, Wherein the substance is at least filled in one of the two chambers.

15. The glow plug according to claim 14, wherein mineral oil is filled into the forward chamber.

16. The glow plug according to claim 14, wherein silicone oil is filled into the backward chamber.

17. The glow plug according to claims 9, wherein the measuring diaphragm is attached to the heater rod.

18. The glow plug according to claim 1, wherein the housing comprises an external thread and the pressure measuring device in the housing is arranged between said external thread and the forward end of said housing.

* * * * *